US006390963B1

(12) United States Patent
Lauderbaugh

(10) Patent No.: US 6,390,963 B1
(45) **Date of Patent: *May 21, 2002**

(54) CORRUGATED BOARD MANUFACTURING APPARATUS INCLUDING A PREHEATER SECTION WITH A VARIABLE HEAT TRANSFER SYSTEM AND A HOTPLATE SECTION WITH A PASSIVE HOLD-DOWN MECHANISIM

(75) Inventor: David Lauderbaugh, Roswell, GA (US)

(73) Assignee: Corrugated Gear & Services, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,470

(22) Filed: Nov. 30, 1998

(51) Int. Cl.[7] ..... B31F 1/20

(52) U.S. Cl. ..... 493/463; 156/64; 156/351; 156/359

(58) Field of Search ..... 493/463; 156/351, 156/359, 210, 470, 583.3, 361, 64; 162/290

(56) References Cited

U.S. PATENT DOCUMENTS

| | | | | |
|---|---|---|---|---|
| 3,779,843 | A | | 12/1973 | Knapp |
| 3,829,338 | A | | 8/1974 | Hayasi et al. |
| 3,960,475 | A | | 6/1976 | DeLigt et al. |
| 3,981,758 | A | | 9/1976 | Thayer et al. |
| 4,071,392 | A | | 1/1978 | Chaudhuri |
| 4,301,598 | A | | 11/1981 | Scardapane |
| 4,497,027 | A | | 1/1985 | McGuire et al. |
| 4,556,444 | A | | 12/1985 | Schommler |
| 5,049,216 | A | | 9/1991 | Shead et al. |
| 5,244,518 | A | | 9/1993 | Krayenhagen et al. |
| 5,256,240 | A | | 10/1993 | Shortt |
| 5,456,783 | A | | 10/1995 | Sissons |
| 5,466,329 | A | | 11/1995 | Marschke |
| 5,501,762 | A | | 3/1996 | Marschke et al. |
| 5,526,739 | A | | 6/1996 | Lauderbaugh et al. |
| 5,527,408 | A | | 6/1996 | Allen |
| 5,611,267 | A | | 3/1997 | Lauderbaugh |
| 5,632,830 | A | | 5/1997 | Marschke |
| 5,656,124 | A | | 8/1997 | Krayenhagen et al. |
| 5,659,976 | A | | 8/1997 | Klockenkemper et al. |
| 5,711,214 | A | | 1/1998 | Lauderbaugh et al. |
| 5,772,819 | A | * | 6/1998 | Olvey ..... 156/210 |
| 5,837,974 | A | * | 11/1998 | Sissons et al. ..... 156/64 |

* cited by examiner

*Primary Examiner*—Eugene Kim
(74) *Attorney, Agent, or Firm*—Michael Mehrman; Gardner Groff Mehrman & Josephic, P.C.

(57) ABSTRACT

A variable heat transfer system and a passive, segmented hold-down mechanism for a preheater section and a hotplate section of a machine for manufacturing corrugated board. The preheater assembly having the variable heat transfer system includes a plurality of actuators to urge a continuous web of material toward a preheater drum. A sacrificial material is positioned between the web of material on the preheater drum and the actuators. In response to moisture detection in the material by a plurality of sensors, one or more of the actuators applies variable pressure in the cross-machine direction to the wet portion of the material. Also, the passive, segmented hold-down mechanism includes a plurality of independently weighted feet for varying a variable pressure profile in the cross-machine direction formed upon the web of corrugated board. The hold-down mechanism compensates for variations in the contour of the surface of the hotplate section.

14 Claims, 5 Drawing Sheets

CORRUGATED BOARD MANUFACTURING APPARATUS INCLUDING A PREHEATER SECTION WITH A VARIABLE HEAT TRANSFER SYSTEM AND A HOTPLATE SECTION WITH A PASSIVE HOLD-DOWN MECHANISIM

FIELD OF THE INVENTION

This invention generally relates to the corrugated board industry and, more particularly, to an apparatus for manufacturing corrugated board that includes a preheater section and hotplate section. Specifically, the apparatus includes a variable heat transfer system for the preheater section and a passive hold-down mechanism for the hotplate section.

BACKGROUND OF THE INVENTION

Corrugated board can be manufactured in many different widths and thicknesses. The thickness of the corrugated board is determined by the number of medians and liners in the board. First, corrugations or ridges are created in a median by passing the median through a corrugator. Then, an alternating series of liners and medians, with an adhesive between each layer, are brought together in a moving surface to form a corrugated board of desired thickness. The moving surface passes through an assembly line that includes the hotplate section, where heat and pressure are applied to dry the board and set the adhesive, and a cooling section, where the corrugated board is cooled. The moving surface is then cut and scored to make corrugated board of different shapes and sizes for boxes and other items.

Uneven moisture content in the source paper, which can cause portions of the board to shrink after the adhesive has set, is the principle cause of warping and the resulting waste encountered in manufacturing corrugated board. Accordingly, it is important to dry the source paper evenly before the medians and liners are brought together to form the board. To prevent warping, the source paper is passed through a preheater assembly that dries the source paper before it is processed by a machine for manufacturing corrugated board.

The preheater assembly typically includes a continuous web feeder, such as an unroller for feeding a continuous web of paper from a long sheet of paper wound around a core, a dryer, and a tension roller located between the feeder and the dryer for taking any slack out of the paper web. The dryer typically includes a large heated drum and two smaller idler rollers that keep the paper web in contact with the heated drum over a substantial portion of the circumference of the heated drum. From the dryer, the paper web travels to the machine for manufacturing corrugated board. Typically, the next stage in the assembly line is either a corrugator section, which flutes a paper web to create a median, or a singlefacer section, which places a layer of adhesive between a median and a liner.

In order for the preheater to dry the paper properly, the paper web must be held tightly against the heated drum. If slack develops in the paper web, air bubbles can form between the paper and the heated drum resulting in uneven moisture content in the paper exiting the dryer. Preventing slack from developing in the paper can be difficult, however, because the paper may have been rolled onto the core with uneven tension across the length of the paper roll. Typically, this causes one edge of the paper web to be taught while the other edge develops slack. This slack can remain in the web after it travels over the tension roller, over the first idler roller, and onto the heated drum, causing air bubbles or loose edges to develop between the web and the drum.

In one conventional moving-web slack-reducing system designed to overcome this problem, the paper web is fed over a vertically-actuated tension roller. The vertical actuators, one typically placed at each end of the tension roller, allow each end of the tension roller to be lifted and lowered a small amount in an attempt to take any slack out of the paper web. But this solution is somewhat wanting in performance because removing the slack from the web requires precise positioning of the actuators. In addition, the tension tends to vary quickly across the paper web as the paper is unrolled. Removing the slack from the web under these conditions therefore requires fairly rapid and precise adjustments of the actuators, which are difficult to achieve at a reasonable level of investment.

In order for the paper to be dried properly, the preheater must also remove wet streaks in the paper. Wet streaks in the paper result in uneven moisture content in the paper. Therefore, extra heat transfer is required between the areas on the paper with the wet streaks and the preheater. However, the tension roller, described above, only moves up and down and not in the crossmachine direction. No known mechanism exists for increasing the heat transfer between the paper and the preheater in the crossmachine direction to eliminate the wet streaks.

The hotplate section of the corrugated board manufacturing apparatus also includes the heated platform section, typically a series of steam chests, that heat the corrugated board to set the adhesive and to remove moisture from the medians and liners. An array of pressure applicators press the corrugated board against the heated platform to assist in moisture removal and heat transfer. The pressure applicators press the corrugated board against the steam chests to ensure adhesion across the entire width of the corrugated board to prevent blisters from forming in the corrugated board.

Because the steam chests tend to warp over time, usually with a sag in the middle, a rigid pressure applicator would crush the edges of the corrugated board and leave blisters in the middle of the board. Many machines are also configured to manufacture corrugated board of varying width. These machines should be capable of varying the pressure applied across the machine width because the edges of the corrugated board, which are only supported by adjacent corrugated board on one side, are easier to crush than the middle of the corrugated board. In addition, it may be desirable to vary the pressure in the cross-machine direction in response to variable moisture content in the board. Specifically, it may be advantageous to apply extra pressure to wetter areas of the board. Devices have been developed with complicated and expensive controls for applying variable pressure across the width of the steam chests (i.e., in the cross-machine direction).

In a typical configuration, the hotplate section of a machine for manufacturing corrugated board includes 16 steam chests that are 7.3 feet (2.2 m) wide and extend in combination about 21 feet (6.5 m) in the direction of machine flow. A row of eight pressure applicators may overlie each steam chest in the cross-machine direction. This allows pressure to be applied over more steam chests for thicker corrugated board and at higher machine speeds. For example, pressure may be applied over only four steam chests (i.e., one group) for single-median corrugated board, over eight steam chests (i.e., two groups) for double-median corrugated board, and over all sixteen steam chests (i.e., four groups) for triple-median corrugated board. In addition, to increase the production output of thinner gauges of board, the machine speed may be increased and pressure may be applied over more steam chests. The hotplate section thus includes a grid of pressure applicators including rows of applicators in the cross-machine direction and columns of applicators in the direction of machine flow.

The conventional configuration described above has certain shortcomings when used to manufacture thick corrugated board, such as triple-median board. Namely, it is difficult to transfer heat from the steam chests all the way through to the top layers of the board. The thicker corrugated board therefore requires more time in the hotplate section to bring the temperature of the top layers of adhesive to the required setting temperature. It is also difficult to remove moisture from wet areas in the top layers, which can cause the board to warp as it dries. To counteract these problems, the speed of the board must be slowed considerably to ensure adequate moisture removal from the top layers of the board and adequate heating of the top layers of adhesive. This decrease in the speed of the assembly line decreases the production output and increases the cost of the thick corrugated board. Another shortcoming is that it is expensive to have a control system to vary the pressure applied to the corrugated board that requires continuous monitoring by an operator. This continuous monitoring in the hotplate section while the machine is manufacturing corrugated board also increases the cost of the corrugated board.

There is a need for a more effective system and method for removing moisture while in the preheater section, before the sheets have been brought together into a formed board. Also, the there is a further need for a more efficient system and method for compensating for variations in the contour of the surface of the steam chests in the hotplate section so that the fabricated corrugated board is cured evenly.

BRIEF SUMMARY OF THE INVENTION

The present invention alleviates or solves the above-described problems in the prior art by providing an improved corrugated board manufacturing apparatus. This apparatus provides a preheater including a variable heat transfer system for removing moisture from the paper sheeting by applying variable pressure in the cross-machine direction. Also, the present apparatus provides a passive, segmented hold-down mechanism that compensates for variations in the contour of the surface of the steam chests. The hold-down mechanism facilitates curing of the adhesive in the formed board. A particular cross-machine pressure profile is desirable across the surface of the steam chests. The variable heat transfer system and the hold-down mechanism each decrease the amount of wasted corrugated board, damaged as a result of uneven moisture content, resulting in substantial cost savings. The use of the hold-down mechanism also results in substantial cost savings because there are no active controls in the hotplate section and because it is cheaper to make the machine with such a hold-down mechanism.

In accordance with one aspect of the present invention, a preheater assembly having a variable heat transfer system includes a plurality of actuators for urging a continuous web of material toward a preheater drum. The actuators press against a sacrificial material which, in turn, presses against the web on the preheater drum. The actuators and sacrificial material are arranged so that variable pressure is placed upon the web in the cross-machine direction through actuation of the actuators. By applying pressure against the web on the preheater drum, air gaps between the web and the preheater drum and the wet streaks in the web can be removed. The heat transfer between the web and the preheater drum is increased by applying pressure against the web on the drum.

More particularly, the actuators may be controlled by a controller. Moisture content sensors are arranged to measure the moisture content of the paper sheeting immediately before the preheater drum. The actuators are responsive to the signals received by the controller such that the paper sheeting is urged against the preheater drum in areas of high moisture content. Additional sensors may also be used immediately after the preheater drum in combination with the other sensors placed ahead of the preheater drum. Alternatively, sensors may be utilized only immediately after the preheater drum. In such case, the controller is referred to as a feedback controller.

In accordance with another aspect of the present invention, a passive, segmented hold-down mechanism for the hotplate section includes a plurality of independently weighted feet for forming a variable pressure profile in the cross-machine direction upon the web of corrugated board. The independently weighted feet compensate for variations in the contour of the surface of the hotplate section. Each of the feet may include a mechanical stop for stopping the foot above the underlying hotplate section. Actuators may be used to raise or lower the feet between no-load and full-load positions. However, once the hold-down mechanism is set for the desired pressure profile, the hold-down mechanism is otherwise free of controls.

The foregoing has broadly outlined some of the more significant objects and features of the present invention. These should be construed to be merely illustrative of some of the more prominent features and applications of the intended invention. Many other beneficial results can be obtained by applying the disclosed invention in a different manner or by modifying the disclosed embodiments. Accordingly, other objects and a more comprehensive understanding of the invention may be obtained by referring to the detailed description of the preferred embodiment taken in conjunction with the accompanying drawings, in addition to the scope of the invention defined by the claims.

DETAILED DESCRIPTION OF EMBODIMENTS OF THE INVENTION

In an apparatus for manufacturing corrugated board, the preheater section receives a continuous web of material (typically paper) from a continuous web feeder, such as an unroller, and delivers the material to a dryer. The dryer typically includes a large heated drum as previously described. The web of the material must be held tightly against a portion of the drum as the drum rotates to prevent slack in the web as well as air bubbles between the web and the drum. In the present invention, actuators combined with a sacrificial material are employed to urge the web against the drum to eliminate the slack and the air bubbles and allow the web to dry properly. Although the actuators of the present invention are primarily described as pneumatic actuators, many other types of actuators could equivalently be used, such as hydraulic actuators, electric servo-motors, cam assemblies, rotating ball screws, pulleys and cables, chains and sprockets, springs levers, elastic connectors, air bag assembly, and the like. By applying pressure against the web on the preheater drum, the air gaps between the web and the preheater drum, as well as any wet streaks in the web, can be removed. The heat transfer between the web and the preheater drum is increased by applying pressure against the web on the drum.

A hold-down mechanism for the hotplate section of the apparatus is also disclosed. The hotplate section typically includes a series of steam chests that heat the corrugated board as previously described. Heating the corrugated board removes moisture and allows the corrugated board to cure properly. It is advantageous to apply a variable pressure profile to the corrugated board on the stream chests to account for warped areas in the surface of the steam chests. However, it has been discovered that continuously varying the pressure placed upon the web of material to remove moisture is not required. Also, it is more economical to substitute active controls in the hotplate section for the passive hold-down mechanism of the present invention.

Thus, it has been discovered that independently weighted feet, as described below, may be used to account for variations in the surface of the steam chest which occur over time. These type of feet are without conventional control mechanisms typically utilized to vary the pressure placed upon the corrugated board passing through the hotplate section. Consequently, the passive hold-down mechanism of the present invention is more suitable for ensuring adequate moisture removal from the formed board because the pressure profile produced by the independently weighted feet does not require continuous monitoring. Since the variations in the surface of the steam chests only vary slightly over time, the pressure profile may remain unchanged for a substantial period of time.

Preheater Section with Variable Heat Transfer System

Figure 2:
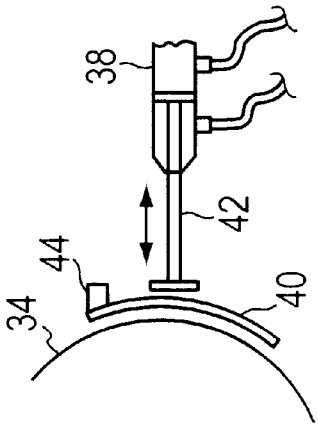
FIG. 2 is a side view of one embodiment of an actuator and the sacrificial material illustrated in FIG. 1.
Figure 1:
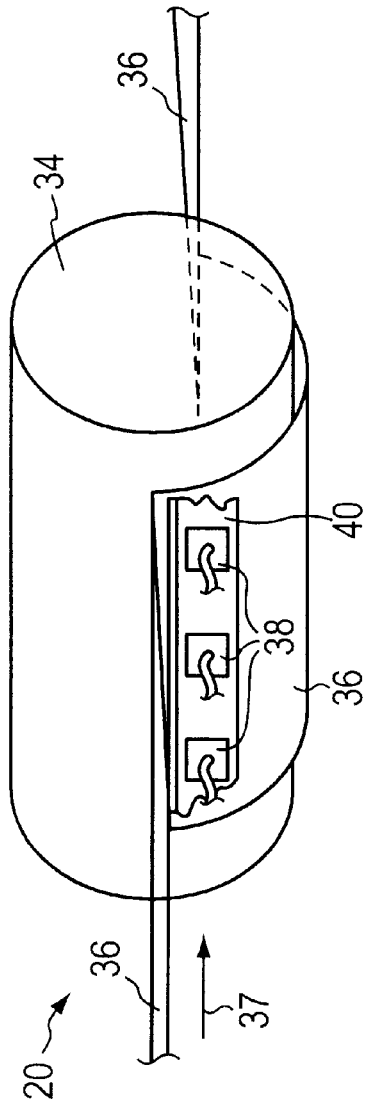
FIG. 1 is a front perspective view of one embodiment of a preheater assembly having a plurality of actuators cooperating with a sacrificial material for urging the continuous web of paper sheets toward a preheater drum in the cross-machine direction.
Figure 3:
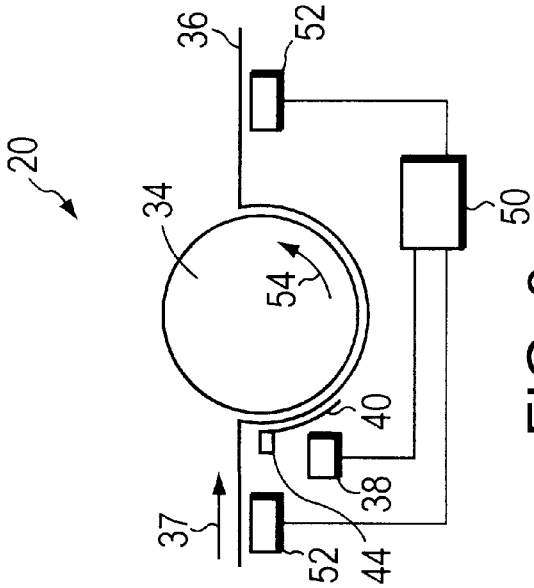
FIG. 3 is a side view of the preheater assembly illustrated in FIG. 1 further including a feedback controller and sensors for measuring moisture content in the web of material.
Figure 4A:
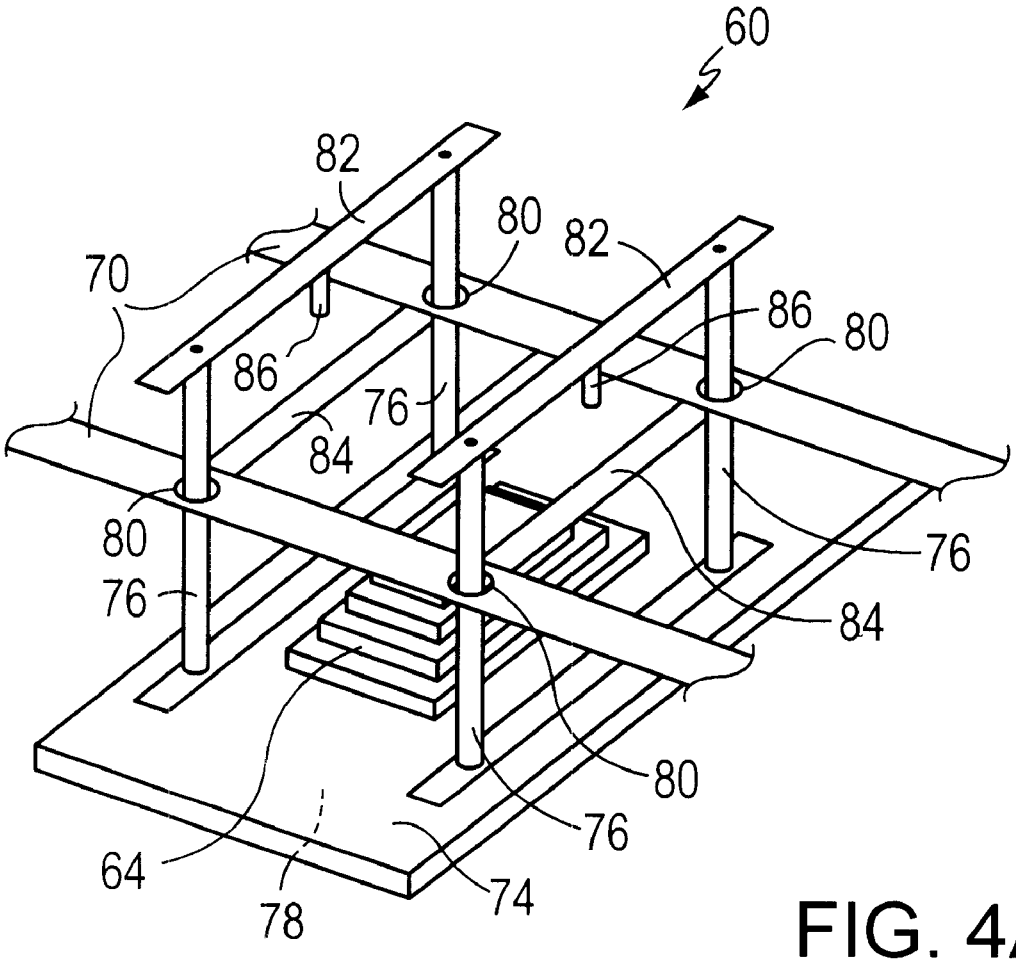
FIG. 4A illustrates an exemplary embodiment of a passive, segmented hold-down mechanism having a plurality of independently weighted feet to compensate for variations in the contour of the surface of the hotplate section.
Figure 4B:
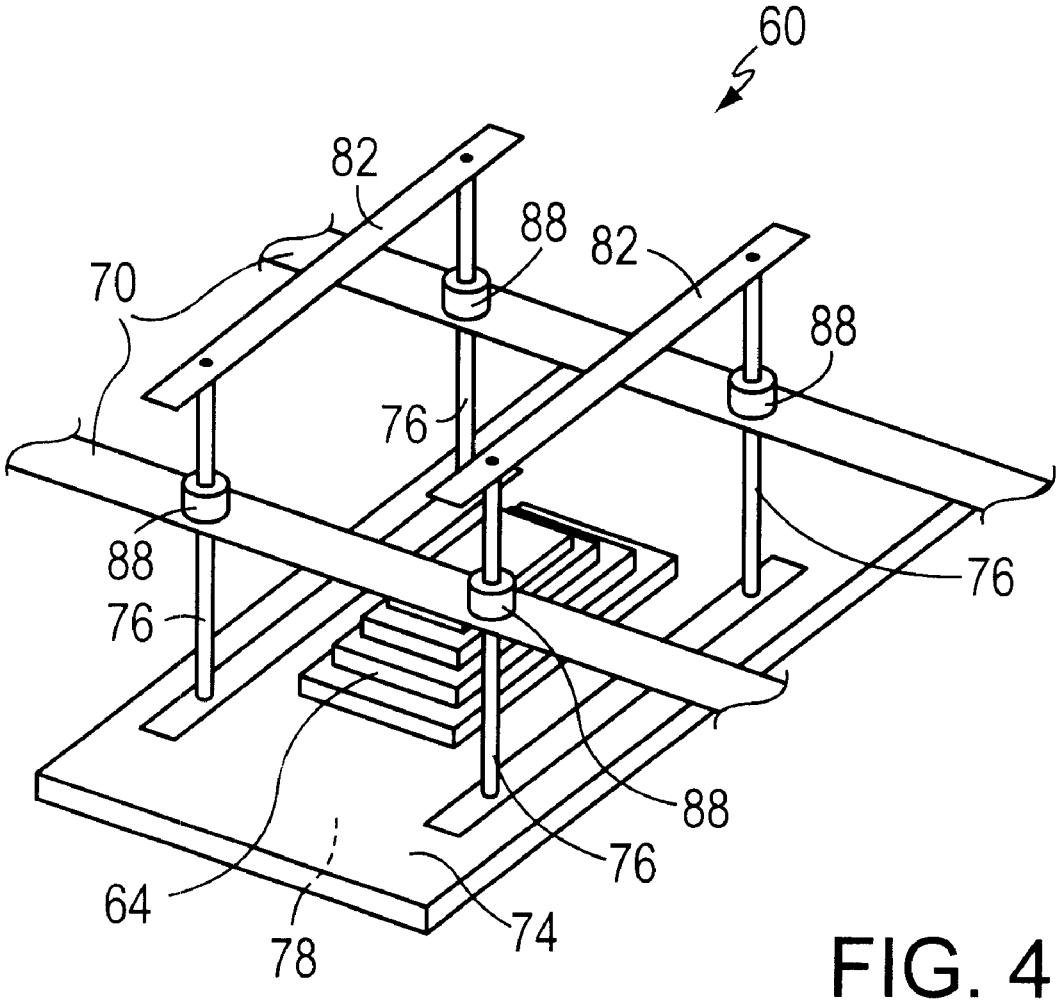
FIG. 4B illustrates a second exemplary embodiment of a passive, segmented hold-down mechanism having a plurality of independently weighted feet to compensate for variations in the contour of the surface of the hotplate section.
Figure 5:
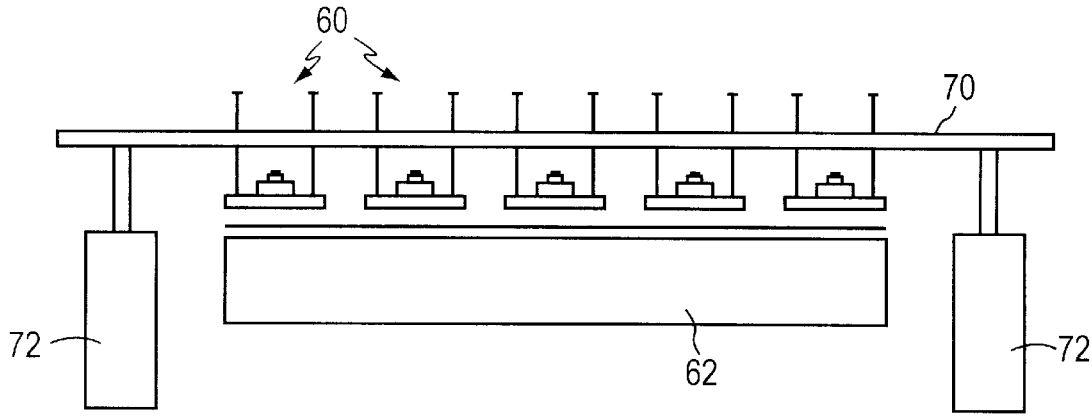
FIG. 5 illustrates the hold-down mechanism of the present invention in a no-load position.
Figure 6:
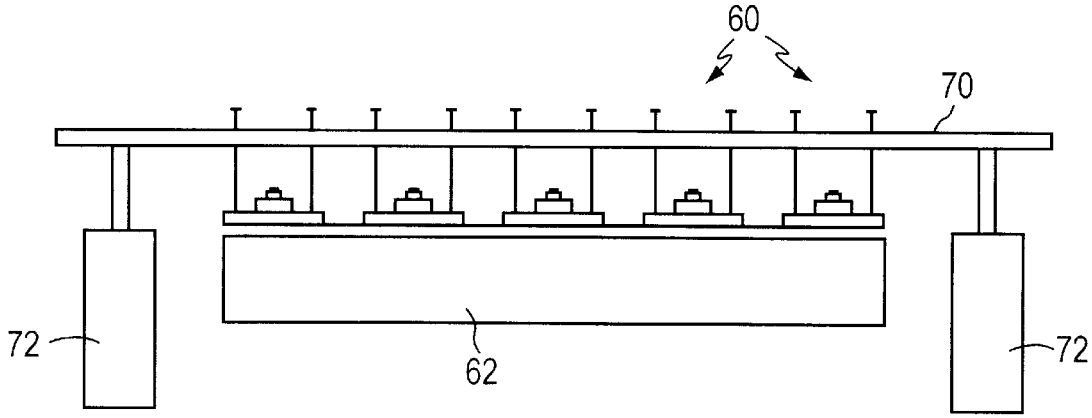
FIG. 6 illustrates the hold-down mechanism of the present invention in a full-load position.
Figure 7:
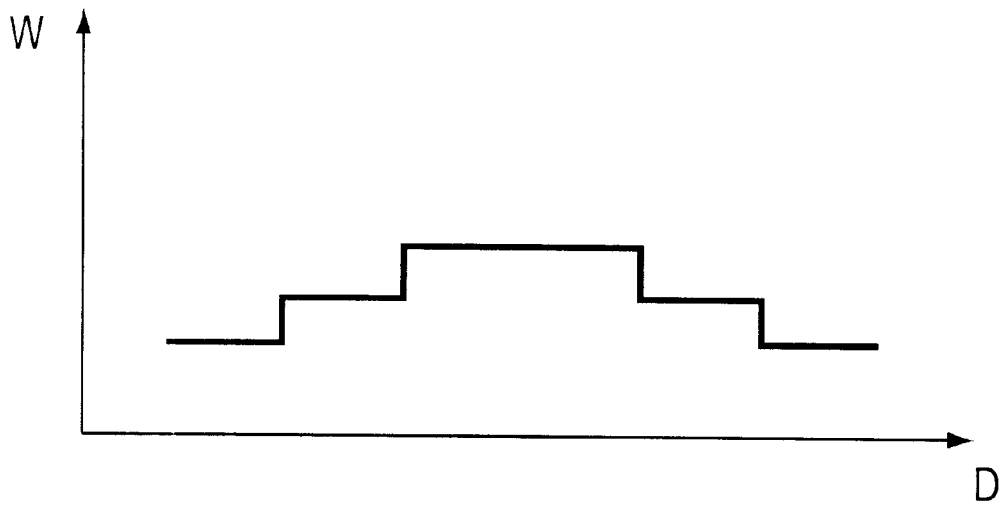
FIG. 7 illustrate the preferred embodiment of the variable pressure profile generated by the hold-down mechanism of the present invention while in the full-load position.
Figure 8:
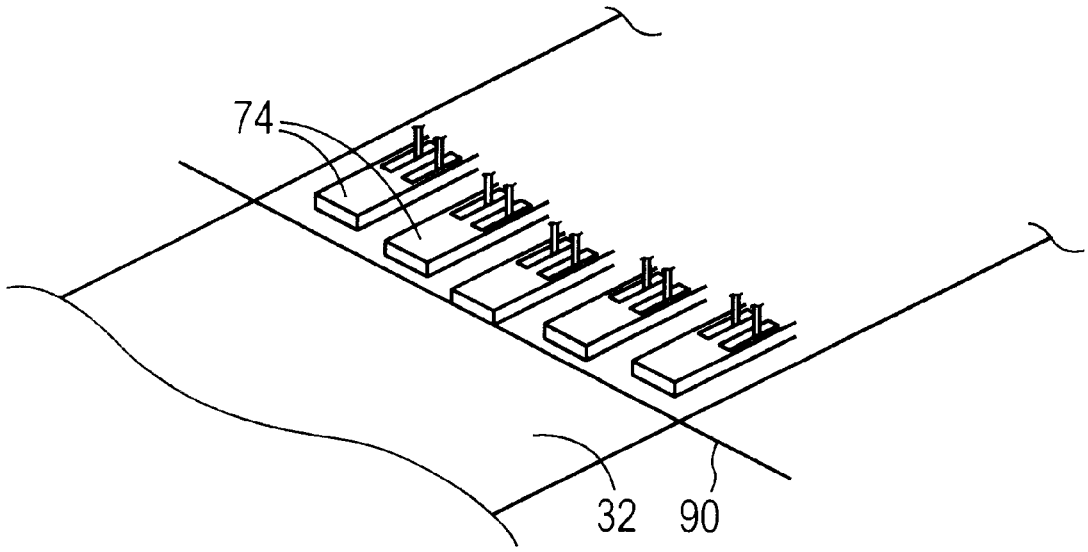
FIG. 8 is a partial front perspective view of the feet of the hold-down mechanism in relation to the corrugate board while producing a variable pressure profile in the cross-machine direction.

Referring now to the drawings, in which like numerals indicate like elements throughout the several views, FIGS. 1–3 illustrate a preheater assembly generally designated by the reference number 20 and FIGS. 4–6 illustrate a passive, segmented hold-down mechanism generally designated by reference number 30. FIG. 7 illustrates the pressure profile generated by the hold-down mechanism 30 on the corrugated board 32 and FIG. 8 illustrates the hold-down mechanism in relation to a continuous web of formed corrugated board 32.

As shown in FIG. 1, one exemplary embodiment of the preheater assembly 20 comprises a dryer commonly referred to as a preheater drum 34 for receiving a continuous web of material 36 such as paper sheeting from a continuous web feeder. The machine direction is indicated by directional arrow 37. The preheater drum 34 is a heated drum commonly known in the art of manufacturing corrugated board 32.

The variable heat transfer system includes a plurality of actuators 38 and a sacrificial material 40 for urging the web of material 36 toward the preheater drum 34. The preferred actuators 38 employed by the present invention may be pneumatic actuators (e.g. air cylinders) with a plunger 42 that cooperate with the sacrificial material 40 as best shown in FIG. 2. It is also preferable that, when actuated, the actuators move between from a fully collapsed position to a fully extended position and vice versa. However, it is within the scope of this invention to include actuators which are capable of being collapsed or extended to intermediate positions somewhere in between. In other words, other types of actuators operable for applying pressure within a range may be used, such as air bags.

Still referring to FIG. 1, the actuators 38 and sacrificial material 40 are configured to urge the web of the material 36 toward the preheater drum 34. Variable pressure may be applied in the cross-machine direction in response to actuation of one or more of the actuators 38. That is, each of the actuators 38 may be independently actuated to apply pressure in the cross-machine direction as desired. Preferably, the sacrificial material consists of any pliable material, such as a piece of an old hold-down belt, which is suitable for sacrificing as a result of applying the variable pressure on the web of material 36 over an extended period of time. Hold down belts are made of a heavy gauge felt material. The sacrificial material 40 is positioned between the preheater drum 34 and the actuators 38 and is secured along its top edge with a fastener 44 as best shown in FIG. 2. Also, it is preferable that the distal end of the plunger 42 includes a pressure plate that is shaped to conform to the outer surface of the preheater drum 34.

The actuators 38 and sacrificial material 40 preferably urge the web of material 36 toward the preheater drum 34 immediately upon the web of material 36 coming into contact with the outer surface of the preheater drum 34 so that gaps created by air trapped between the web of material 36 and the preheater drum 34 may be removed. As a result, it has been found that applying pressure to a wet area of the web of material 36 effectively removes any excess moisture from that area of the web of material 36 and, therefore, a more uniform moisture content in the web of material 36 may be obtained prior to forming the corrugated board 32.

As shown in FIG. 3, the preheater assembly 20 of the present invention may further include a controller 50 and one or more moisture content sensors 52 for controlling the pressure applied by the actuators 38 to the web of material 36. In FIG. 3, the machine direction is again indicated by directional arrow 37. Also, the direction which the preheater drum is rotating is indicated by directional arrow 54. The feedback controller 50 typically includes a software module and hardware components and is responsive to the signals received by the sensors 52. The sensors 52 may be arranged on either or both sides of the preheater drum 34. For example, sensors may be located just prior to when the web of material 36 comes into contact with the preheater assembly 20 and just after exiting the preheater assembly 20. A row of sensors 52 is typically aligned in the cross-machine direction across the web of material 36. The controller 50 responds to the detection of moisture by actuating the actuators 38 which urge the web of material 36 toward the preheater drum 34 in the areas of detected moisture. Preferably, the resulting moisture content of the material 36 is substantially uniform in the cross-machine direction as the material 36 exits from the preheater drum 34.

Hotplate Section with Passive Hold-Down Mechanism

FIGS. 4A and 4*b* illustrate two exemplary embodiments of feet 60 of the hold-down mechanism 30, which are identical except for the manner in which each foot 60 is stopped above the underlying hotplate section having steam chests 62. The manner in which each foot 60 is stopped is described in greater detail below. The feet 60 are independently weighted with incremental weights 64 to vary a variable pressure profile formed on the web of corrugated board in the cross-machine direction. To increase or decrease the weight of each foot 60 and vary the pressure profile, one or more weights 64 may be added or removed from each foot 60. The preferred pressure profile generated by the feet 60 is discussed in greater detail below.

As shown in both FIGS. 4A and 4B, each foot 60 includes a mechanical stop for adjusting the minimum height of the foot above the underlying steam chests 62 of the hotplate section. The mechanical stop, described in greater detail below, prevents the foot from contacting the underlying steam chests 62 when the board 32 is not running under that particular foot. The row of feet 60 are supported under a support structure consisting of support members 70, which extend over the hotplate section in the cross-machine direction. The feet 60 may be raised or lowered by a pair of actuators 72 that move the structure supporting the feet 60. The actuators 72 may be pneumatic or hydraulic actuators. The actuators 72, shown in FIGS. 5 and 6, are typically placed on either end of the support members 70 that support the feet 60. Each individual actuator 72 may be identical to actuators 38 used in the preheater section as described above. For example, actuators equivalent to actuators 72, such as pneumatic or hydraulic actuators, an electric-servo motor, a ball screw, a cam assembly, an air bag assembly or any other suitable type of mechanism may instead be utilized to produce a mechanical force.

The feet 60 in FIG. 5 are raised into a no-load position above the stream chests and, in FIG. 6, the feet 60 are lowered into a full-load position where the feet 60 rest upon the web of material 36 and the steam chests 62. The pressure profile on the corrugated board is produced by lowering the feet 60 onto the corrugated board and the pressure profile is removed by raising the feet 60 from the web of corrugated board. The pressure profile is described in greater detail below.

Still referring to FIGS. 4A and 4B, each foot 60 further includes a flat rectangular section 74 having elongated members 76 extending vertically from the flat rectangular section 74. The rectangular section 74 has a contact surface 78 that slides over the hold-down belt which, in turn, presses against the corrugated board 32 when the feet 60 are in the full-load position and the fabrication equipment is operating. The elongated members 76 extend through apertures 80 in the support members 70 to cross members 82. The cross members 82 extend between adjacent support members 70. Because the elongated members 76 are free to extend through the apertures 80, the feet 60 are free to move relative to the support structure and the underlying steam chests 62.

In FIG. 4A, the feet 60 are stopped above the underlying steam chests 62 by an elongated protruding member 86 that extends downward from beneath each cross member 82. The distal ends of the protruding members 86 abut the cross members 84 when the feet 60 are not to move any further towards the web of material 36 or the steam chests 62. Also, when the feet 60 are raised by actuators 72 into the no-load position, the elongated protruding members 86 again abut the cross members 84. The proximal ends of the protruding members 86 are threaded into apertures (not shown) in the cross members 82. The length of each protruding member 86 may be varied by altering the depth of the protruding member 86 in the cross member 82. The height of the respective foot 60 above the steam chests 62 is varied by varying the length of the protruding members 86.

The mechanical stop of foot 60 illustrated in FIG. 4B does not include the protruding members 86 or the cross members 84. Alternatively, the mechanical stop of foot 60 in FIG. 4B includes a sleeve 88 which extends upward from each aperture 80. The elongated members 76 extend through each sleeve 88 as a result of passing through each respective aperture 80. The proximal ends of the sleeves 88 may be threaded into the apertures 80. Thus, the length of each sleeve 88 may be varied by altering the depth of the sleeves 88 in the apertures 80 and, consequently, the height of the respective foot 60 above the steam chests 62 may be varied.

The hold-down mechanism 30 is calibrated by placing the hold-down mechanism in the full-load position. The height of the mechanical stops of the feet 60 are adjusted so that the feet 60 are level above the hotplate section. FIG. 7 illustrates the preferred embodiment of the pressure profile generated by the weight of the feet 60 on the corrugated board 32 when the corrugated board 32 is passing through the hotplate section. However, when there is no corrugated board 32 passing through the hot plate section, there will be a slight gap between the steam chests and the feet 60. FIG. 7 is a graph illustrating the relationship between the distance D in the cross machine direction and the weight W of each foot 60. The pressure profile is highest at the center of the board 32 and tapers toward the edges. This pressure profile serves a three-fold purpose by recognizing that (i) the surface of the hotplate section tends to warp in the center, (ii) moisture in the corrugated board 32 will be pushed from the center out towards the edges, and (iii) the edges are more easily crushed than the center of the corrugated board 32. Thus, the pressure profile becomes flatter as the profile approaches the edges of the corrugated board. Because the desired cross-machine pressure profile does not vary quickly over time, control over the pressure profile is not necessary. For this reason, the passive, segmented hold-down mechanism 30 is a cost effective alternative.

FIG. 8 further illustrates the pressure profile in the cross-machine direction in relation to the corrugated board 32. In relation to a reference axis general designated as reference number 90, the feet 60 are more heavily weighted at the center than at the edges of the corrugated board 32. For example, with a hold-down mechanism having eight feet, each foot of the outer most pair of feet could weigh 35 lbs. Then, each foot of the next pair of feet inward could weigh 38 lbs. Each foot of the next pair of feet adjacent the center foot could weigh 40 lbs., and the two center feet could weigh 45 lbs. The machine for manufacturing corrugated board with the hold-down mechanism 30 of independently weighted feet 60 is otherwise free of any other means for varying the pressure profile upon the web of corrugated board 32.

However, in instances where multiple, parallel rows of independently feet extend over the web of corrugated board in the cross-machine direction, the pressure profile in the machine direction should be gradually curved. That is, the additional pressure exerted upon the center areas of the corrugated board should taper over successive rows of feet in the machine direction. For example, the first row of feet in the machine direction may have the pressure profile described above (i.e. 35, 38, 40, 45, 45, 40, 38, 35), whereas the last row of feet in the machine direction may have 35 lbs. applied to each foot (i.e. 35, 35, 35, 35, 35, 35, 35, 35). In this case, the addition weight applied to the center of the corrugated board will gradually taper in the machine direction. Specifically, the pressure applied by the two center feet will gradually taper from 45 lbs. to 35 lbs., the pressure applied by the adjacent two feet will gradually taper from 40 lbs. to 35 lbs., and so forth.

The use of the preheater assembly 20 as described above constitutes an inventive method of the present invention in addition to the preheater assembly 20 itself. In practicing the method of drying a web of continuous material for use in the manufacture of corrugated board as described above, the steps include feeding the web of material 36 into the dryer. Portions of the web of material having a relatively high moisture content relative to the remaining portions of the web are detected. The web of material 36 is then urged toward the dryer as described above in response to detecting the relatively high moisture content portion of the web of material. In other words, in response to detecting wet areas in the web of material, variable pressure in the cross-machine direction is applied to the web of material with a sacrificial material 40 to increase the pressure applied to the wet areas. The preheater assembly 20 may also sense the moisture content of the web of material 36 and urge the web of material 36 toward the dryer in response to detecting excessive moisture both immediately before and immediately after the dryer as described above.

The use of the passive, segmented hold-down mechanism 30 as described above also constitutes an inventive method of the present invention in addition to the hold-down mechanism 30 itself. In practicing the method of curing a continuous web of corrugated board in the hotplate section of a machine for manufacturing corrugated board, the steps include feeding a continuous web of corrugated board to the hotplate section. A variable pressure profile is applied in the cross-machine direction to the web of corrugated board with the feet 60 as described above.

The present invention has been illustrated in great detail by the above specific examples. It is to be understood that these examples are illustrative embodiments and that this invention is not to be limited by any of the examples or details in the description. Those skilled in the art will recognize that the present invention is capable of many modifications and variations without departing from the scope of the invention. Accordingly, the detailed description and examples are meant to be illustrative and are not meant to limit in any manner the scope of the invention as set forth in the following claims. Rather, the claims appended hereto are to be construed broadly within the scope and spirit of the invention.

What is claimed is:

1. A machine for manufacturing corrugated board comprising:

a heated platform positioned adjacent to a continuous web of material traveling in a machine flow direction above the heated platform;

a plurality of independently weighted feet positioned above the web of material for applying gravitational pressure urging the web of material toward the heated platform;

the plurality of independently weighted feet situated across the web of material in a cross-machine direction that is transverse to the machine flow direction; and the plurality of independently weighted feet comprising weights selected to impart a pre-selected pressure profile that varies across the web of material in the cross-machine direction.

2. The machine for manufacturing corrugated board of claim 1, wherein the pressure profile is greatest in the center of the web of material and tapers toward the edges of the web of material.

3. A preheater for a machine for manufacturing corrugated board comprising:

a heated drum positioned adjacent to a continuous web of material traveling in a machine flow direction adjacent to a portion of an outer periphery of the heated drum;

a plurality of independently actuated feet positioned adjacent to the web of material for applying pressure urging the web of material toward the heated drum;

the plurality of independently actuated feet situated across the web of material in a cross-machine direction that is transverse to the machine flow direction;

the plurality of independently actuated feet configured to impart a pressure profile that varies across the web of material in the cross-machine direction;

one or more sensors for detecting one or more areas of the web of material containing relatively increased levels of moisture; and a controller for altering the pressure profile imparted by the independently actuated feet to apply increased pressure to the areas of the web of material containing the relatively increased levels of moisture.

4. The preheater of claim 3, further comprising a sacrificial material positioned between the independently actuated feet and the web of material.

5. The preheater of claim 3, wherein the sensors for detecting one or more areas of the web of material containing relatively increased levels of moisture comprise a plurality of sensors situated in the cross-machine direction and positioned before the heated drum.

6. The preheater of claim 3, wherein the sensors for detecting one or more areas of the web of material containing relatively increased levels of moisture comprise a plurality of sensors situated in the cross-machine direction and positioned after the heated drum.

7. The preheater of claim 5, wherein the sensors for detecting one or more areas of the web of material containing relatively increased levels of moisture comprise a plurality of sensors situated in the cross-machine direction and positioned after the heated drum.

8. A machine for manufacturing corrugated board comprising:

a preheater including:

a heated drum positioned adjacent to a continuous web of material traveling in a machine flow direction adjacent to an outer periphery of the heated drum, a plurality of independently actuated feet positioned adjacent to the web of material for applying pressure urging the web of material toward the heated drum, the plurality of independently actuated feet situated across the web of material in a cross-machine direction that is transverse to the machine flow direction, and the plurality of independently actuated feet configured to impart a pressure profile that varies across the web of material in the cross-machine direction; and a hotplate section including:

a heated platform positioned adjacent to the continuous web of material traveling above the heated platform in the machine flow direction, a plurality of independently weighted feet positioned above the web of material for applying gravitational pressure urging the web of material toward the heated platform, the plurality of independently weighted feet situated across the web of material in the cross-machine direction, and the plurality of independently weighted feet comprising weights selected to impart a pressure profile that varies across the web of material in the cross-machine direction.

9. The machine for manufacturing corrugated board of claim 8, wherein the pressure profile toward the heated platform is greatest in the center of the web of material and tapers toward the edges of the web of material.

10. The machine for manufacturing corrugated board of claim 9 further comprising:

one or more sensors for detecting one or more areas of the web of material containing relatively increased levels of moisture; and a controller for altering the pressure profile imparted by the independently actuated feet to apply increased pressure to the areas of the web of material containing relatively increased levels of moisture.

11. The machine for manufacturing corrugated board of claim 10 further comprising a sacrificial material positioned between the independently actuated feet and the web of material.

12. The machine for manufacturing corrugated board of claim 10 wherein the sensors for detecting one or more areas of the web of material containing relatively increased levels of moisture comprise a plurality of sensors situated in the cross-machine direction and positioned before the heated drum.

13. The machine for manufacturing corrugated board of claim 10 wherein the sensors for detecting one or more areas of the web of material containing relatively increased levels of moisture comprise a plurality of sensors situated in the cross-machine direction and positioned after the heated drum.

14. The machine for manufacturing corrugated board of claim 12 wherein the sensors for detecting one or more areas of the web of material containing relatively increased levels of moisture comprise a plurality of sensors situated in the cross-machine direction and positioned after the heated drum.

* * * * *